US006017165A

United States Patent [19]

Sorkin

[11] Patent Number: 6,017,165

[45] **Date of Patent: *Jan. 25, 2000**

[54] WEDGE-RECEIVING CAVITY FOR AN ANCHOR BODY OF A POST-TENSION ANCHOR SYSTEM

[76] Inventor: Felix L. Sorkin, 4115 Greenbriar Dr., Stafford, Tex. 77477

[ * ] Notice: This patent is subject to a terminal disclaimer.

[21] Appl. No.: 09/157,800

[22] Filed: Sep. 21, 1998

Related U.S. Application Data

[63] Continuation-in-part of application No. 09/007,608, Jan. 15, 1998.

[51] Int. Cl.[7] ..... F16B 2/14; E04C 3/10

[52] U.S. Cl. ..... 403/374.1; 403/371; 52/223.13

[58] Field of Search ..... 403/374.1, 373, 403/367, 368, 371; 52/223.13, 223.14

[56] References Cited

U.S. PATENT DOCUMENTS

| | | | |
|---|---|---|---|
| 3,820,832 | 6/1974 | Brandestini et al. | 52/223.13 X |
| 3,844,697 | 10/1974 | Edwards | 52/223.13 X |
| 3,975,799 | 8/1976 | Kerr | 52/223.13 X |
| 4,223,497 | 9/1980 | Edwards | 52/223.13 |
| 4,561,226 | 12/1985 | Tourneur | 52/223.13 |
| 4,662,134 | 5/1987 | Illgner | 52/223.13 |
| 4,719,658 | 1/1988 | Kriofske | 52/223.13 |
| 4,773,198 | 9/1988 | Reinhardt | 52/223.13 |
| 4,918,887 | 4/1990 | Davis et al. | 52/223.13 |
| 5,345,742 | 9/1994 | Rogowsky et al. | 52/223.13 X |
| 5,347,777 | 9/1994 | Sudduth | 52/223.13 |
| 5,469,677 | 11/1995 | Luthi | 52/223.13 |
| 5,749,185 | 5/1998 | Sorkin | 52/223.13 |
| 5,839,235 | 11/1998 | Sorkin | 52/223.14 X |

FOREIGN PATENT DOCUMENTS

| | | | |
|---|---|---|---|
| 236663 | 12/1961 | Australia | 52/223.13 |
| 2097443 | 11/1982 | United Kingdom | 52/223.13 |

*Primary Examiner*—Harry C. Kim
*Attorney, Agent, or Firm*—Harrison & Egbert

[57] ABSTRACT

An improved anchor for a post-tension system having an anchor body with an internal wedge-receiving cavity. The cavity has a first portion of constantly diminishing diameter extending inwardly from one end of the anchor body. The first portion has an angle of taper with respect to a center line of the cavity. The cavity has a second portion extending inwardly from an opposite end of the anchor body. The first portion and the second portion are coaxial and communicate with each other. The second portion has an angle of taper which is less than the first portion. The first and second portions are cast with the anchor body. The angle of taper of the second portion is less than seven degrees or a negative angle with respect to the center line.

12 Claims, 5 Drawing Sheets

WEDGE-RECEIVING CAVITY FOR AN ANCHOR BODY OF A POST-TENSION ANCHOR SYSTEM

RELATED APPLICATIONS

The present application is a continuation-in-part of U.S. patent application Ser. No. 09/007,608;, filed on Jan. 15, 1998 and entitled "Wedge-Receiving Cavity for an Anchor Body of a Post-Tension Anchor System", presently pending.

TECHNICAL FIELD

The present invention relates to post-tension anchor systems, in general. More particularly, the present invention relates to the structure of an anchor body for such post-tension systems. Furthermore, the present invention more specifically relates to the formation of the cavity within the interior of the anchor body.

BACKGROUND ART

For many years, the design of concrete structures imitated typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive (vertical) load, is extremely weak in carrying significant tensile loads. It becomes necessary, therefore, to add steel bars, called reinforcements, to concrete, thus allowing the concrete to carry the compressive forces and the steel to carry the tensile (horizontal) forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as 100 feet can be attained in members as deep as three feet for roof loads. The basic principal is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principal, but the reinforcing is held loosely in place while the concrete is placed around it. The reinforcing is then stretched by hydraulic jacks and securely anchored into place. Prestressing is done with individual members in the shop and post-tensioning as part of the structure on the site.

In a typical tendon tensioning anchor assembly in such post-tensioning operations, there is provided a pair of anchors for anchoring the ends of the tendons suspended therebetween. In the course of installing the tendon tensioning anchor assembly in a concrete structure, a hydraulic jack or the like is releasably attached to one of the exposed ends of the tendon for applying a predetermined amount of tension to the tendon. When the desired amount of tension is applied to the tendon, wedges, threaded nuts, or the like, are used to capture the tendon and, as the jack is removed from the tendon, to prevent its relaxation and hold it in its stressed condition.

Metallic components within concrete structures may be come exposed to many corrosive elements, such as de-icing chemicals, sea water, brackish water, or spray from these sources, as well as salt water. If this occurs, and the exposed portions of the anchor suffer corrosion, then the anchor may become weakened due to this corrosion. The deterioration of the anchor can cause the tendons to slip, thereby losing the compressive effects on the structure, or the anchor can fracture. In addition, the large volume of by-products from the corrosive reaction is often sufficient to fracture the surrounding structure. These elements and problems can be sufficient so as to cause a premature failure of the post-tensioning system and a deterioration of the structure.

FIGS. 1 and 2 illustrate various components of a typical post-tension assembly designated generally at 10. System 10 includes a tendon 12 having an exposed end protruding from a sheath 14. The end of the tendon 12 is typically fitted through an extension tube 16. Extension tube 16 has a diameter slightly larger than sheath 14 such that one end 16*a* of tube 16 may overlie sheath 14. The opposite end 16*b* of tube 16 fits over, and communicates with, a rear tubular portion 18 of an anchor 20. Rear tubular member 18 includes an aperture (not shown) which communicates with a frontal aperture 22. Frontal aperture 22 defines a cavity in which wedges 24 and 26 are received as shown in FIG. 2, below.

FIG. 2 illustrates an assembled view (in one-fourth cut-away perspective) of system 10 shown in FIG. 1. As known in the art, tendon 12 is disposed through extension tube 16 and through anchor 20. In one known embodiment, end 16*b* of extension tube 16 is force-fitted over rear tubular member 18. The other end 16*a* of extension tube 16 is sealed to sheath 14, by use of tape or other means.

After tendon 18 extends through frontal aperture 22 (see FIG. 1), and assuming the far end of the tendon (not shown) is fixed in place, tension is applied to tendon 16, typically by use of a hydraulic jack. While applying this tension, wedges 24 and 26 are forced in place on both sides of tendon 12 within the wedge cavity defined by aperture 22. Once in place, teeth 24*a* and 26*a* of wedges 24 and 26 operate to lock tendon 12 in a fixed position with respect to anchor 20.

Thereafter, the tension supplied by the hydraulic device is released and the excess tendon extending outward from anchor 20 is cut by a torch or other known device. Wedges 24 and 26 thereafter prevent tendon 12 from releasing its tension and retracting inward with respect to anchor 20. Moreover, this tension provides additional tensile strength across the concrete structure.

After years of work with the anchor body of the prior art, it was found that the cavity used in the anchor body created many problems. The cavity in the anchor body is of a constantly diminishing diameter extending from a forward end of the anchor body to a rearward end of the anchor body. This internal cavity of constantly diminishing diameter is formed during the casting of the anchor body. Unfortunately, the narrow diameter end of the cavity creates problems with the installation of tendons in a corrosion-resistant environment.

When the anchor body is used in the formation of intermediate anchorages, it is often necessary to move the anchor body over a very long length of sheathed tendon. If there is insufficient clearance between the narrow diameter end of the cavity and the outer diameter of the sheathed portion of the tendon, nicks, abrasions, and cuts can occur in the corrosion-resistant sheathing. As such, the integrity of the anchorage system is impaired. Furthermore, there are circumstances where the sheathing may exceed expected tolerances and will prevent the anchor body from easily sliding along the length of the tendon so as to assume its position as an intermediate anchorage. Additionally, in recent years, there has been a tendency to increase the thickness of the sheathing so as to facilitate greater protection of the tendon from corrosive elements.

An easy solution to this problem would be to expand the diameter of the cavity so as to avoid the aforementioned problems. Unfortunately, if the diameter of the cavity is expanded, then conventional wedges cannot be used. Problems would further occur because of the use of larger wedges or of irregular wedges. If the cavity were enlarged, then the wedge components would have to be replaced in all such post-tension anchor systems. Furthermore, the use of variant sized wedges could create new problems associated with the tensioning of the anchor system.

It is also possible to drill out the narrow diameter end of the cavity so as to produce a portion of generally constant diameter. However, any past attempts at drilling have been unsuccessful for a number of reasons. First, the drilling is a very expensive process in comparison with the casting of the anchors. Furthermore, the drilling of a constant diameter portion in the anchor body can create burrs and deformations which could potentially cut the sheathing of the tendon and cause adverse corrosion-protection results. Finally, the drilling of the hole can intrude into the wedge-receiving area so as to create an uneven and irregular contact area between the wedges and the wall of the cavity.

U.S. patent application Ser. No. 09/007,608, filed on Jan. 15, 1998, by the present inventor, describes an improved anchor for a post-tension system which has a cavity with a first portion of constantly diminishing diameter and a second portion of constant diameter. The first and second portions are coaxial and communicate with each other. The first portion extends inwardly from one end of the anchor body while the second portion extends inwardly from the opposite end of the anchor body. This improved anchor is a cast anchor. However, it was found that the formation of the second portion of "constant diameter" created problems during the casting process. It is known that for making cast objects, it is often difficult to cast or form cavities of constant diameter. Constant diameter cavities in objects often require complex forms and molds in order to create such constant diameter cavities. As such, the constant diameter second portion created certain manufacturing problems.

It is an object of the present invention to provide an improved anchor for a post-tension anchor system which allows for the use of existing wedges in the wedge cavity while enlarging the narrow end of the cavity.

It is a further object of the present invention to provide an improved anchor body with a cavity with a wide end which requires no machining.

It is a further object of the present invention to provide an anchor body that avoids sharp edges and irregular contact surfaces.

It is still another object of the present invention to provide an anchor body which enhances the corrosion resistance of the post-tension anchor system.

It is still a further object of the present invention to provide an improved anchor body which is relatively inexpensive, easy to manufacture, and easy to use.

These and other objects and advantages of the present invention will become apparent from a reading of the attached specification and appended claims.

SUMMARY OF THE INVENTION

The present invention is an improved anchor for a post-tension system which includes an anchor body having an internal wedge-receiving cavity. The cavity has a first portion having an angle of taper of constantly diminishing diameter extending inwardly from one end of the anchor body. The cavity has a second portion extending inwardly from an opposite end of the anchor body. The first portion and the second portion are coaxial and communicate with each other. The first and second portions are cast with the anchor body. The second portion has an angle of taper less than or negative to the angle of taper of the first portion.

The first portion has a wide end opening at the one end of the body. The first portion has a narrow end of a diameter no less than the constant diameter of the second portion. The first portion is tapered at an approximately 7° angle relative to the centerline of the cavity. The second portion extends inwardly from the opposite end of the anchor body for no less than one-quarter of an inch. In one form of the present invention, the second portion has a larger diameter at the opposite end of the anchor body than the diameter at the narrow end of the first portion.

In the present invention, a tendon extends through the cavity. A plurality of wedges are arranged in interference fit relationship between a wall of the first portion and an exterior surface of the tendon. Each of the plurality of wedges has a length not more than a length of the first portion. The tendon has a sheathing extending thereover. The second portion has a diameter greater than the diameter of the sheathing on the tendon.

DETAILED DESCRIPTION OF THE INVENTION

Figure 3:
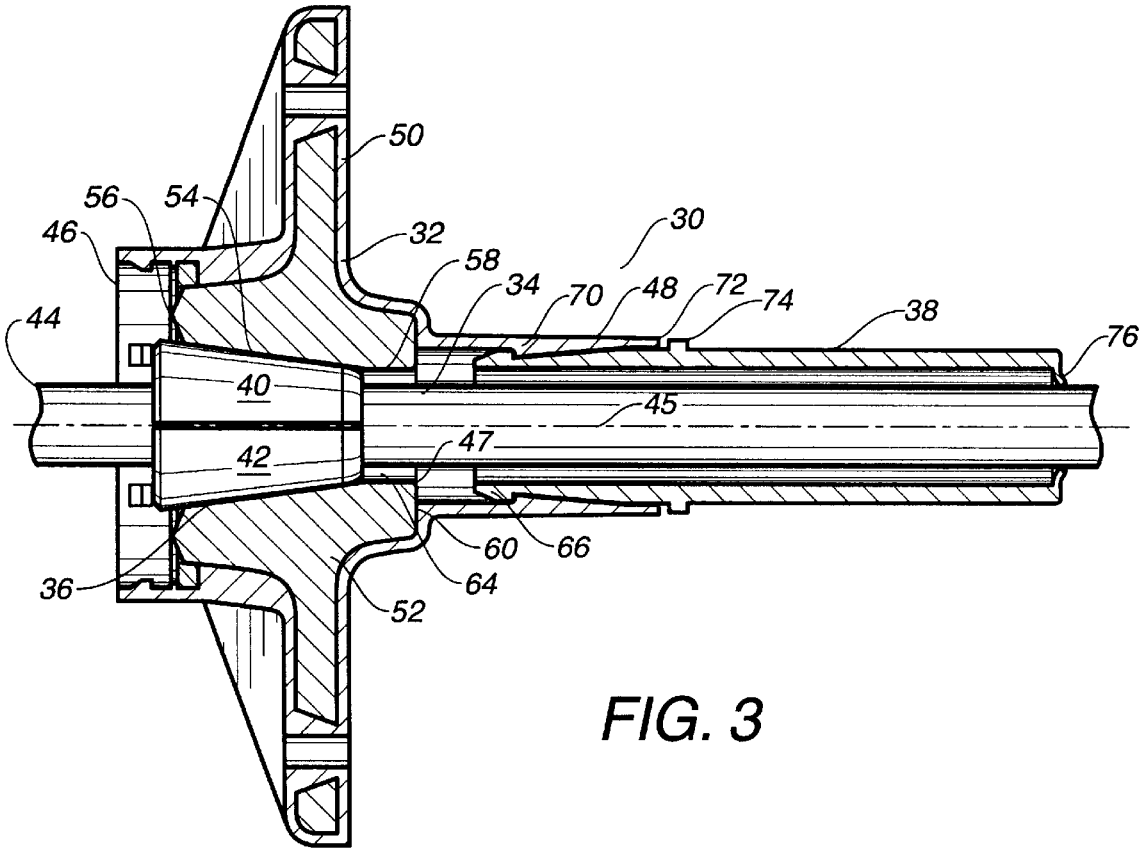
FIG. 3 is a cross-sectional view showing the post-tension system of the present invention.

Referring to FIG. 3, there is shown at 30 the improved post-tension anchor system in accordance with the teachings of the present invention. The post-tension anchor system 30 includes an anchor body 32, a tendon 34 extending through a cavity 36 in the anchor body 32, and a corrosion-protection tube 38 extending around an exterior of the tendon 34. The tendon 34 is retained in proper position within the anchor body 32 through the use of wedges 40 and 42. Wedges 40 and 42 are arranged in interference fit relationship between the wall of the cavity 36 and the exterior surface of the tendon 34. The tendon 36 has one end 44 extending outwardly of a forward end 46 of the anchor body 32. A tubular portion 48 is formed in encapsulation material 50 so as to extend outwardly from an opposite end of the anchor body 32. The encapsulation material 50 is a polymeric encapsulation that surrounds the steel anchor 52.

In the present invention, the cavity 36 has a first portion 54 of constantly diminishing diameter extending inwardly from end 56 of the steel anchor 52. The internal cavity 36 also includes a second portion 58 extending extending inwardly from an opposite end 60 of the steel anchor 52. The first portion 54 communicates with the second portion 58. The first portion is coaxial with the second portion 58. The second portion 58 has an angle of taper which is less than the angle of taper of the first portion 54. Alternatively, as will be described hereinafter, the angle of taper of the second portion can actually be a negative angle relative to the angle of taper of the first portion. As used herein, the term "angle of taper" refers to the angle of the wall of the cavity 36 in relation to the center line 45 of the anchor body 32.

As can be seen in FIG. 3, the wedges 40 and 42 are fit within the first portion of the cavity 36. Wedges 40 and 42 are standard wedges used in conventional prior art anchor systems. The first portion 54 of cavity 56 will have a diameter similar to the diameter of existing cavities. The taper of the first portion 54 is approximately a 7° angle relative to the longitudinal axis of cavity 36.

Unlike prior art systems, the second portion 58 has an angle of taper which is less than the angle of taper of the first portion 54. The second portion 58 extends from an end of the first portion 54 to the end 60 of the steel anchor 52. Prior art anchor systems had a constant taper extending from end 56 to end 60 of the steel anchor 52. As can be seen, a significant clearance 64 is formed between the wall of the second portion 58 of cavity 36 and the exterior surface of tendon 34. As such, the steel anchor 52 can slide easily along the length of the tendon 34 without causing damage to the sheathing on the tendon. Furthermore, since the first portion 54 is formed by casting with the second portion 58, no machining is required. As such, the expense of the production of the anchor body 32 is reduced. There will be no sharp burrs or snarled edges which could compromise the integrity of the sheathing of the tendon 34.

In FIG. 3, it can be seen that the corrosion-protection tube 38 includes a forward end 66 having a spearhead-shaped configuration. The wide end of the spearhead-shaped configuration is in snap-fit engagement with a shoulder 70 formed on the interior of the tubular portion 48. The end 72 of the tubular portion 48 will abut a shoulder 74 formed on the exterior surface of the corrosion-protection tube 38. A sealing member 76 is formed on the opposite end of the corrosion-protection tube 38 so as to establish a liquid-tight seal with the exterior surface of the tendon 34. In order to install the corrosion-protection tube 38, it is only necessary to insert the spearhead-shaped end 66 into the opening at end 72 of the tubular portion 48. The corrosion-protection tube 38 can then be pushed inwardly of the tubular portion 48 until the end 66 snap-fits over the shoulder 70.

Figure 4:
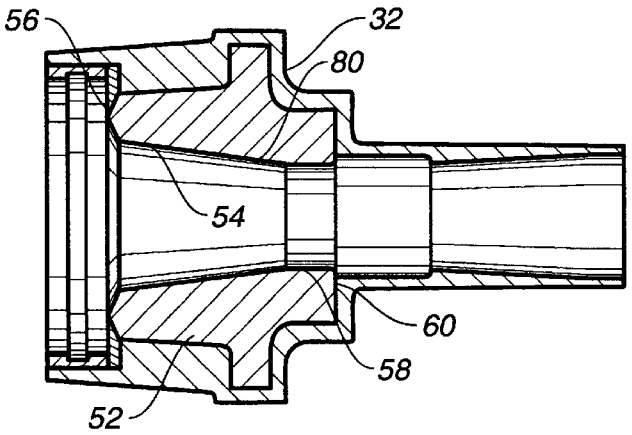
FIG. 4 is a cross-sectional view showing the anchor body in accordance with the teachings of the present invention.

FIG. 4 is an isolated view showing the anchor body 32. In FIG. 4, it can be seen that the first portion 54 is illustrated as tapering from end 56. The narrow end 80 of the first portion 54 connects with the second portion 58. The second portion 58 extends from the end 80 of the first portion 54 to the end 60 of the steel anchor 52. The second portion 58 has an angle of taper less than or negative to the first portion 54. Within the concept of the present invention, it is possible that the second portion 80 could have a slightly increasing diameter extending from the end 80 of the first portion 54 toward the end 60 of the steel anchor 52. The second portion 58 will have a diameter of between 0.6 and 0.7 inches. In the preferred embodiment of the present invention, the second portion 58 will extend inwardly from the end 60 for no less than one-quarter of an inch. The first portion 54, as can be seen, has a length which is greater than the length of the second portion 58.

Figure 1:
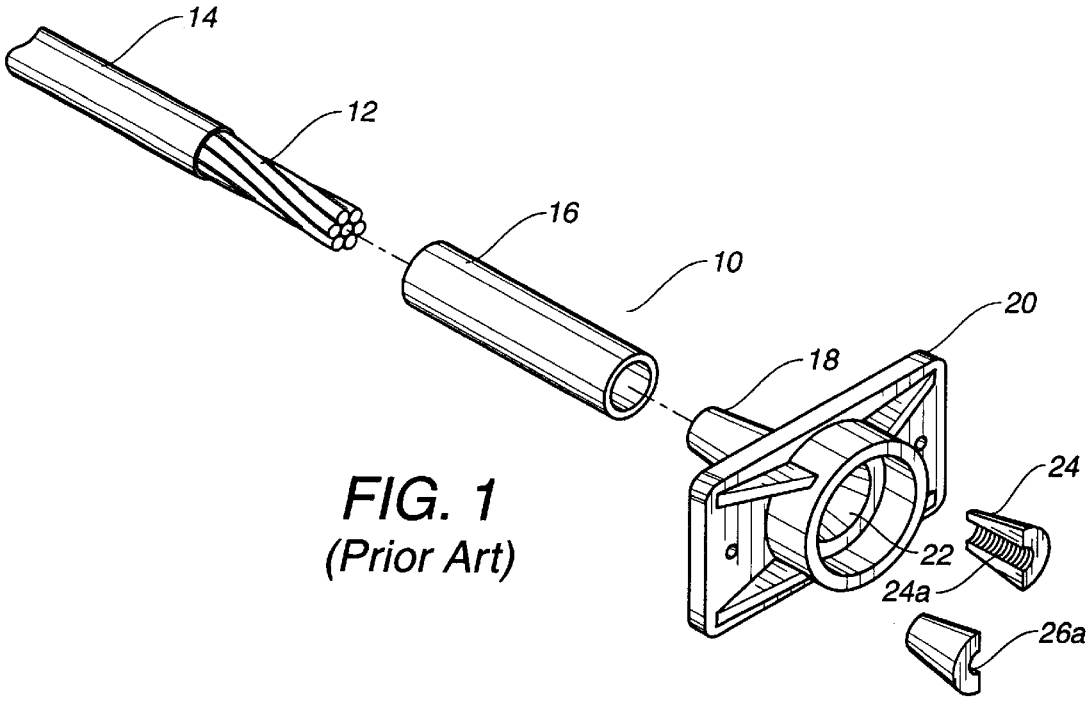
FIG. 1 (Prior Art)
FIG. 1 is a perspective exploded view of a prior post-tension anchor system.
Figure 2:
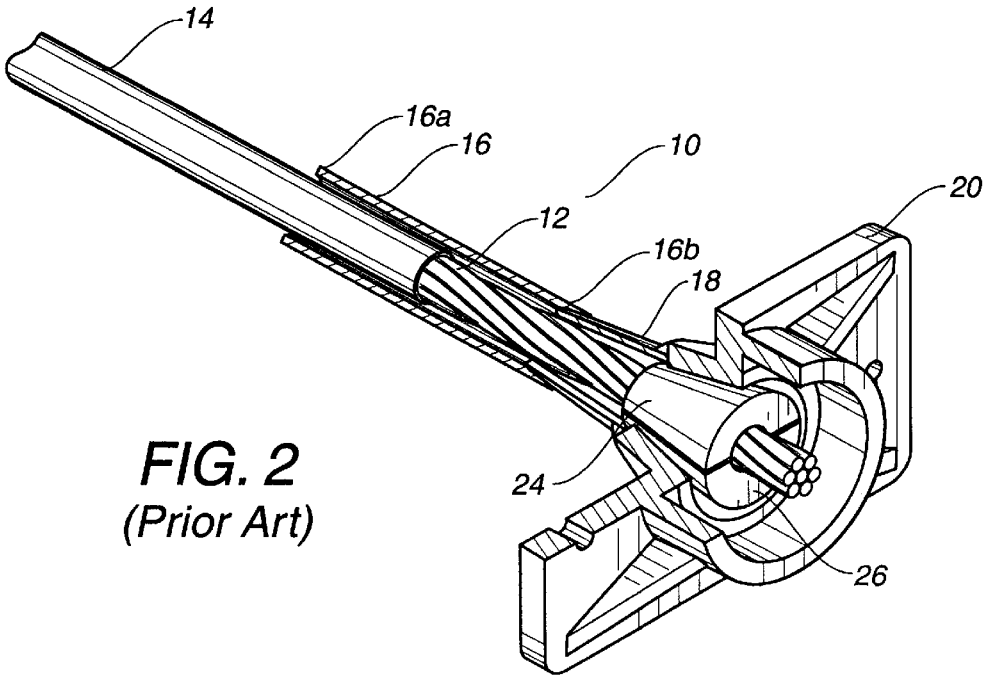
FIG. 2 (Prior Art)
FIG. 2 is an assembled view of the prior art post-tension anchor system of FIG. 1.

Referring to FIG. 1, it can be seen that the steel anchor 52 of anchor body 32 has a cavity 36 with a first portion 54 that extends inwardly from the end 56. It can be seen in FIG. 5 that the first portion 54 has a constant diameter extending from the end 56 to the end 80. The first portion 54 transitions to the second portion 58 at end 80.

Figure 5:
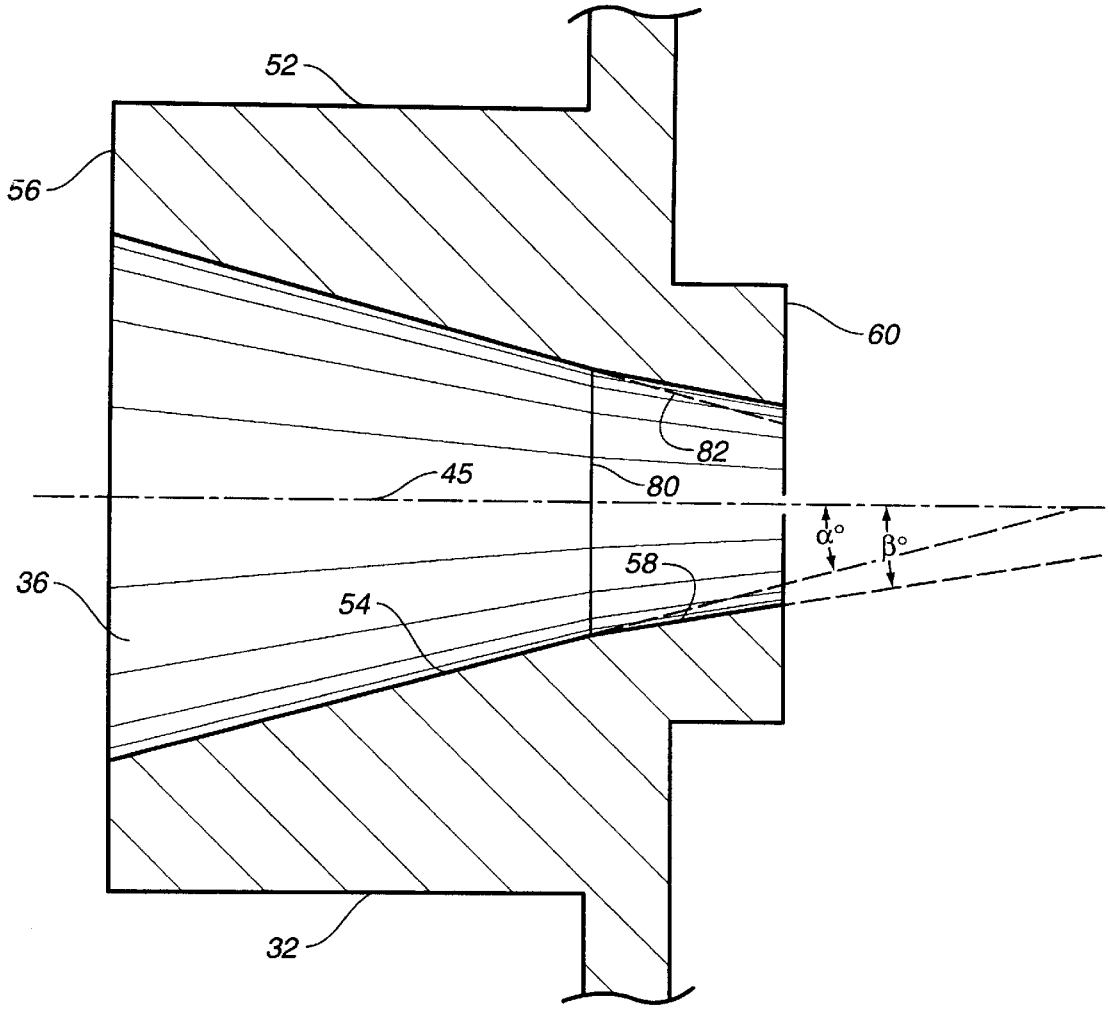
FIG. 5 is a greatly enlarged and exaggerated view of the cavity of the anchor body in accordance with the preferred embodiment of the present invention.

FIG. 5 illustrates how the present invention differs from the prior art. As can be seen by the broken line 82, the constantly decreasing diameter of the first portion 54 would normally continue from end 56 to end 60. However, since the second portion 58 has a taper which is less than the angle of taper of the first portion 54, the second portion 58 will emerge on end 68 with a greater diameter than which would occur by the continuously tapering first portion 54. As shown in FIG. 5, the angle of taper of the first portion 54 is shown by $\alpha$. The angle of taper of the second portion 58 is shown by $\beta$. In accordance with the present invention, angle $\beta$ is less than angle $\alpha$.

Figure 6:
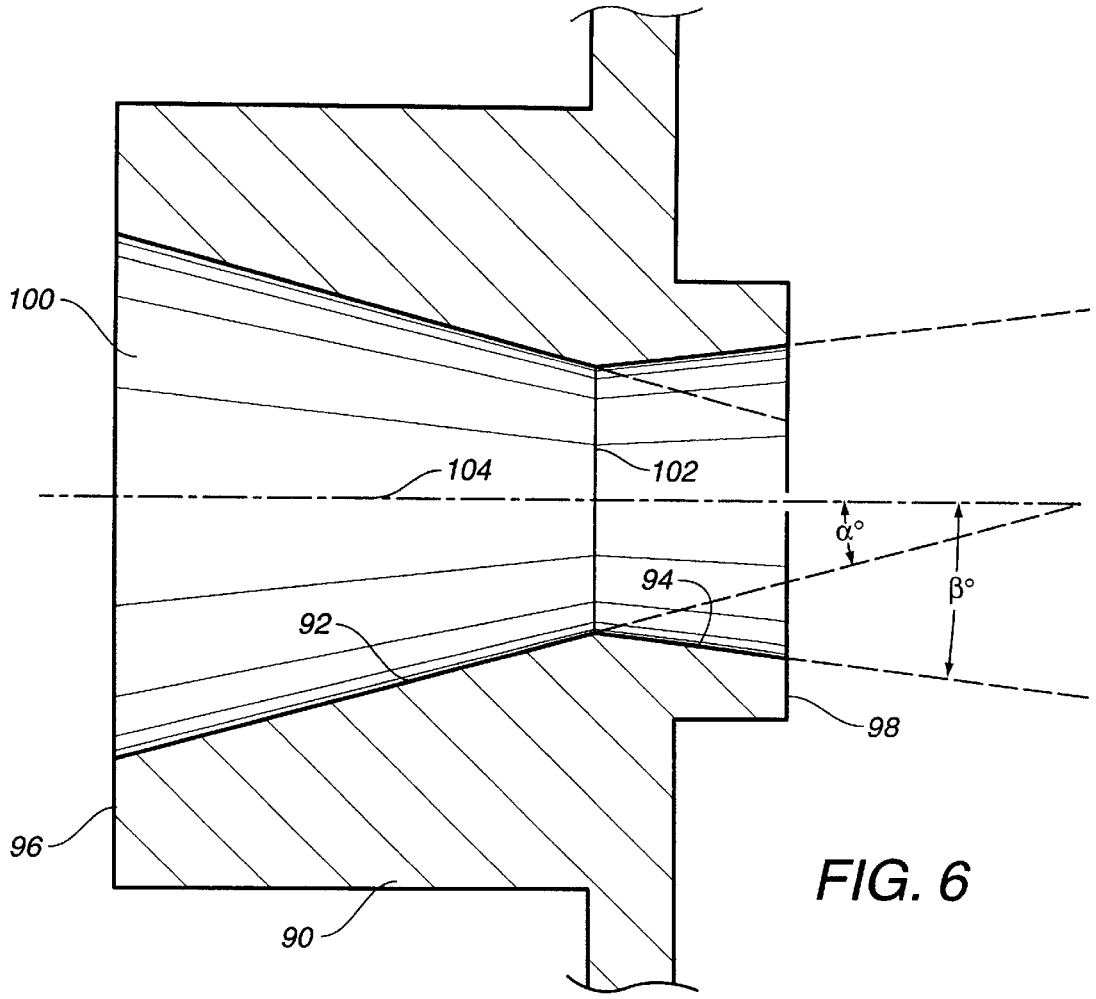
FIG. 6 is a greatly enlarged and exaggerated view of the cavity of the anchor body in accordance with a first alternative embodiment of the present invention.

FIG. 6 shows an alternative embodiment of the present invention. In FIG. 6, the anchor body 90 has a first portion 92 and a second portion 94. The first portion 92 opens at end 96 of the anchor body 90. The second portion 94 opens at the opposite end 98 of the anchor body 90. The first portion 92 of cavity 100 connects with the second portion 94 at end 102.

It can be seen in FIG. 6 that the first portion 92 has a constantly narrowing diameter extending from end 96 to the end 102. The second portion 94 has a constantly expanding diameter as extending from the end 102 to the end 98. Alternatively stated, the second portion 94 constantly tapers so as to narrow in diameter from the end 98 of anchor body 90 to the end 102 of the first portion 92 of cavity 100.

As can be seen in FIG. 6, the first portion 92 has an angle a relative to the center line 104. The second portion 94 forms an angle $\beta$ with respect to the center line 104. The angle $\beta$ is negative to angle $\alpha$. As such, angle $\beta$ is also less than angle $\alpha$ relative to the center line 104.

The embodiment shown in FIG. 6 offers certain advantages. For example, the constantly widening diameter of the second portion 94 (as extending from end 102 to the end 98) will serve to "funnel" the tendon through the cavity 100 of the anchor body 90. This outward taper can, under certain circumstances, facilitate the manufacture and casting of the anchor body 90. Since the second portion 94 has a greater diameter at end 98 than the diameter of the first portion 92 at end 102, the second portion 94 will suitably accommodate the sheathing on a tendon extending therethrough.

Figure 7:
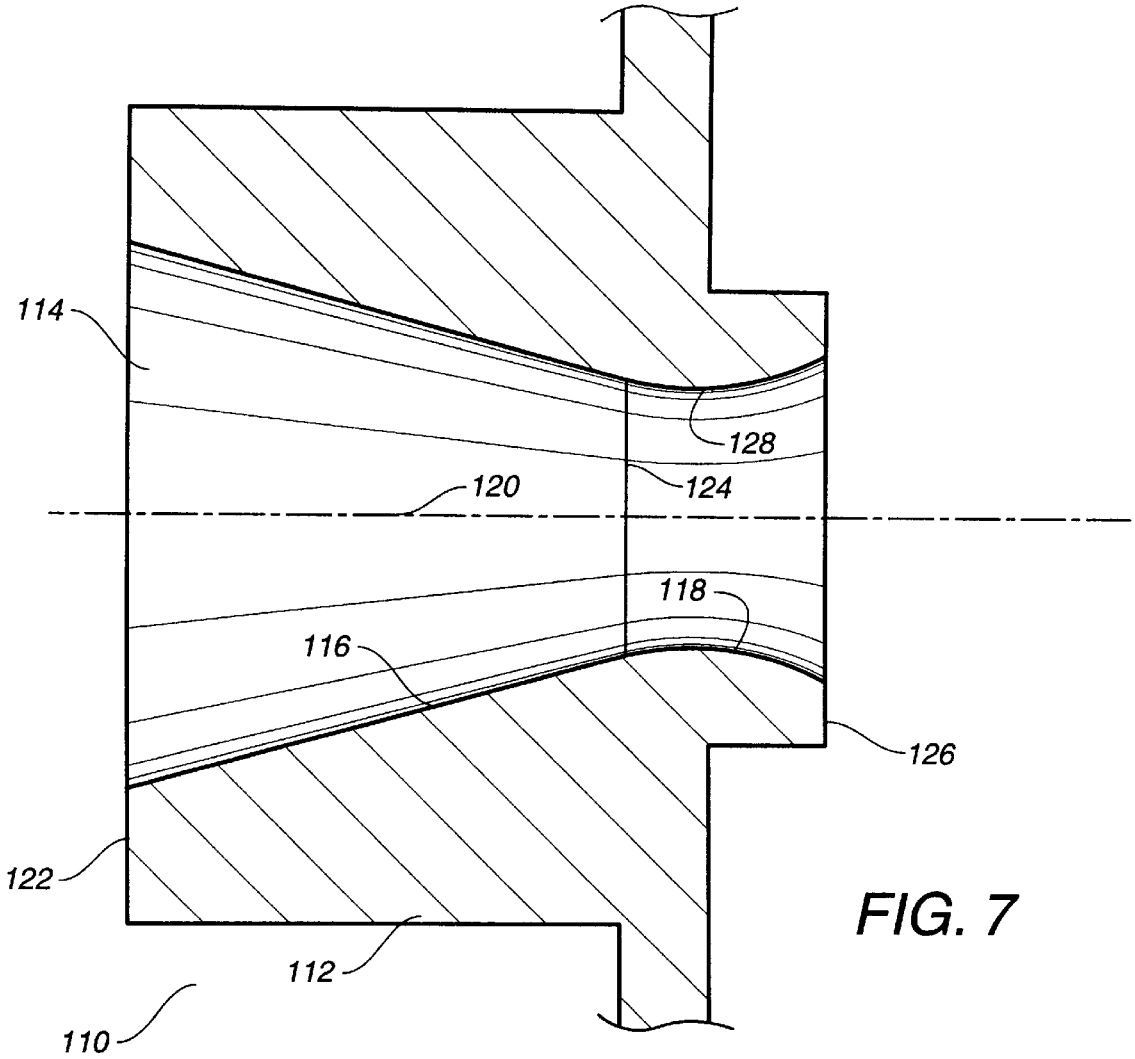
FIG. 7 is a greatly enlarged and exaggerated view of a second alternative embodiment of the present invention.

FIG. 7 shows an alternative embodiment 110 of the present invention. The alternative embodiment 110 includes an anchor body 112 having a cavity 114 extending therethrough. The cavity 114 includes a first portion 116 and a second portion 118. A center line 120 is illustrated as extending through the interior of the cavity 114. The first portion 116 will extend from end 122 of the anchor body 112 to the end 124 of the first portion 116. The first portion 116 will transition into the second portion 118 at end 124

The second portion 118 has a generally non-constantly expanding diameter extending from the end 124 to the end 126 of the anchor body 112. As can be seen, the wall 128 of the second portion 118 is suitably radiused so as to expand outwardly at end 126. The second portion 118 has a wide diameter end at the end 126 of the anchor body 112 and a narrow diameter end at the narrow end 124 of the first portion 116. Generally speaking, the angle formed by the second portion 118 relative to the center line 120 will be a negative angle relative to the angle formed between the wall of the first portion 116 and the center line 120. As such, the angle of taper of the second portion 118 will be less than (or negative to) the angle of taper of the first portion 116.

The radiused walls of the second portion 118 are somewhat different to configure in a manufacturing process but would offer a different advantage than the previous embodiments of the present invention. The smooth curving of the wall 128 of the second portion 118 will serve to "funnel" the tendon through the cavity 114. Furthermore, while accomplishing this "funneling" purpose, the smooth transition offered by the curved wall 128 will prevent any inadvertent nicking of the sheathing of the tendon at the area of the transition end 124.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. An improved intermediate anchor for a post-tension system, the improvement comprising:

an anchor body having an internal wedge-receiving cavity, said cavity having a first portion of constantly diminishing diameter extending inwardly from one end of said anchor body, said first portion having an angle of taper with respect to a center line of said cavity, said cavity having a second portion extending inwardly from an opposite end of said anchor body, said first portion and said second portion being coaxial and communicating with each other, said second portion having an angle of taper less than said angle of taper of said first portion, said second portion having a constantly increasing diameter extending inwardly from said opposite end of said anchor body.

2. The improvement of claim 1, said first and second portions being cast with said anchor body.

3. The improvement of claim 1, said angle of taper of said first portion being approximately 7 degrees relative to the center line of said cavity, said angle of taper of said second portion being less than 7 degrees.

4. The improvement of claim 1, said second portion extending inwardly from opposite end for no less than one-quarter of an inch.

5. The improvement of claim 1, further comprising:

a tendon extending through said cavity; and a plurality of wedges in interference fit relationship between a wall of said first portion and an exterior surface of said tendon.

6. The improvement of claim 5, each of said plurality of wedges having a length not more than a length of said first portion.

7. The improvement of claim 5, said tendon having a sheathing extending therearound, said second portion having a diameter greater than a diameter of said sheathing on said tendon.

8. The improvement of claim 5, said anchor body being encapsulated with a polymeric material, said polymeric material forming a tubular portion extending outwardly of said opposite end of said anchor body, said tendon extending through said tubular portion.

9. The improvement of claim 1, said first portion having a length greater than a length of said second portion.

10. An improved intermediate anchor for a post-tension system, the improvement comprising:

an anchor body having an internal wedge-receiving cavity, said cavity having a first portion of constantly diminishing diameter extending inwardly from one end of said anchor body, said first portion having an angle of taper with respect to a center line of said cavity, said cavity having a second portion extending inwardly from an opposite end of said anchor body, said first portion and said second portion being coaxial and communicating with each other, said second portion having an angle of taper less than said first portion, said second portion having a larger diameter at said opposite end of said anchor body than a diameter of a narrow end of said first portion; and a tendon extending through said cavity, said tendon having a sheathing extending therearound exterior of said cavity, said narrow end of said first portion having a diameter greater than a diameter of said sheathing on said tendon.

11. The improvement of claim 10, said second portion having a constantly narrowing diameter extending inwardly from said opposite end of said anchor body.

12. The improvement of claim 10, said second portion having a radiused wall.

* * * * *